US006064319A

United States Patent [19]

Matta

[11] Patent Number: 6,064,319

[45] Date of Patent: May 16, 2000

[54] METHOD AND SYSTEM FOR REGULATING SWITCHING OF A TRAFFIC LIGHT

[76] Inventor: David M. Matta, 316 Fairfield Dr., State College, Pa. 16801

[21] Appl. No.: 09/177,783

[22] Filed: Oct. 22, 1998

[51] Int. Cl.[7] ..... G08G 1/017

[52] U.S. Cl. ..... 340/917; 340/902; 340/906; 340/990; 340/995; 364/424.01

[58] Field of Search ..... 340/917, 990, 340/995, 906, 902, 600; 364/436, 424.01, 454

[56] References Cited

U.S. PATENT DOCUMENTS

| | | | |
|---|---|---|---|
| 4,758,959 | 7/1988 | Thoone et al. | 340/990 |
| 5,172,113 | 12/1992 | Hamer | 340/906 |
| 5,506,774 | 4/1996 | Nobe et al. | 340/995 |
| 5,539,398 | 7/1996 | Hall et al. | 340/995 |
| 5,602,739 | 2/1997 | Haagenstad et al. | 340/906 |
| 5,699,986 | 12/1997 | Welk | 340/902 |
| 5,802,445 | 9/1998 | Wiedeman et al. | 340/600 |
| 5,847,661 | 12/1998 | Ricci | 340/902 |

*Primary Examiner*—Edward Lefkowitz
*Assistant Examiner*—Davetta W. Goins
*Attorney, Agent, or Firm*—Baker Botts L.L.P.

[57] ABSTRACT

A method and system for regulating switching of a traffic light includes determining the location of a vehicle. The method and system further includes transmitting an information signal comprising information related to the vehicle in response to determining the location of the vehicle. The method and system includes determining whether the traffic light should be switched based on the information signal. Finally, the method and system includes switching the traffic light if necessary in response to determining whether the traffic light should be switched.

9 Claims, 2 Drawing Sheets

METHOD AND SYSTEM FOR REGULATING SWITCHING OF A TRAFFIC LIGHT

TECHNICAL FIELD OF THE INVENTION

The invention relates in general to the field of vehicular traffic control and more specifically to a method and system for regulating switching of a traffic light.

BACKGROUND OF THE INVENTION

Control of vehicular traffic on roads is important to the proper functioning of society and its economy. To provide such control, traffic light switching systems are employed. One conventional traffic light switching system counts a predetermined number of vehicles entering a road intersection and change the lights accordingly. Some conventional traffic light switching systems, referred to as "loop detectors" include a conductive loop detector embedded in the road. The conductive loop generates an electromagnetic field. A signal is transmitted to a traffic light controller if the proper number of vehicles have passed over the conductive loop and through the electromagnetic field. The traffic light controller then switches the traffic light, if appropriate. In addition to electromagnetic fields, prior systems have also used pressure sensors to determine the presence of a vehicle.

The use of physical loop detectors in conventional traffic light switching systems is primitive and conventionally used only to detect the existence of traffic in a specific direction. A problem with physical loop detectors is that they are permanently embedded in the roadway and cannot be quickly or easily moved or modified. In addition, physical loop detector systems cannot selectively change a traffic light based on the type of vehicle passing over the detector. Current systems also cannot receive information from other sources to determine whether to change the light for a particular vehicle. As a result, conventional traffic light switching systems perform at a lower level than desired.

Other systems have been developed to solve this problem by allowing the drivers of certain vehicles to send a signal to the traffic light controller in order to change the traffic light. However, the problem with such a system is that it cannot prioritize different signals coming from separate vehicles. In addition, the drivers of such vehicles can switch traffic signals in their favor even if it is not essential. This misuse of the system has an adverse effect on other vehicular traffic.

SUMMARY OF THE INVENTION

Accordingly, a need has arisen for an improved method and system for detecting a vehicle's presence at or approaching a traffic light and determining whether to change the traffic light in response to that vehicle. The present invention provides a method and apparatus for regulating switching of a traffic light that addresses the shortcomings of prior methods and systems.

According to one embodiment of the invention, a method of regulating switching of a traffic light includes determining the location of a vehicle. The method transmits an information signal comprising information related to the vehicle in response to determining the location of the vehicle. The method further includes determining whether the traffic light should be switched based on the information signal. Finally, the method switches the traffic light if necessary in response to determining whether the traffic light should be switched.

According to another embodiment of the invention, a system includes a traffic light and a vehicle sensor. The system further includes a vehicle tracking unit operable to determine a location of the vehicle and further operable to send an information signal to a traffic light controller. The traffic light controller includes a control system operable to receive the information signal from the vehicle tracking unit and further operable to switch the traffic light in response to the information signal.

Embodiments of the invention provide numerous technical advantages. For example, according to one embodiment of the invention a traffic signal is switched when it is essential to the vehicle's objective. For instance, the present invention is selectively operable to switch a traffic signal in favor of a public transportation vehicle, such as a bus or trolley, when that vehicle is behind schedule. Another technical advantage of the present invention is the elimination of the need to install and maintain a physical loop detector, as required by some prior systems.

Other technical advantages are readily apparent to one skilled in the art from the following figures, descriptions, and claims.

BRIEF DESCRIPTION OF THE DRAWINGS

For a more complete understanding of the present invention and its advantages, reference is now made to the following descriptions taken in connection with the accompanying drawings in which.

DETAILED DESCRIPTION OF THE INVENTION

Figure 1:
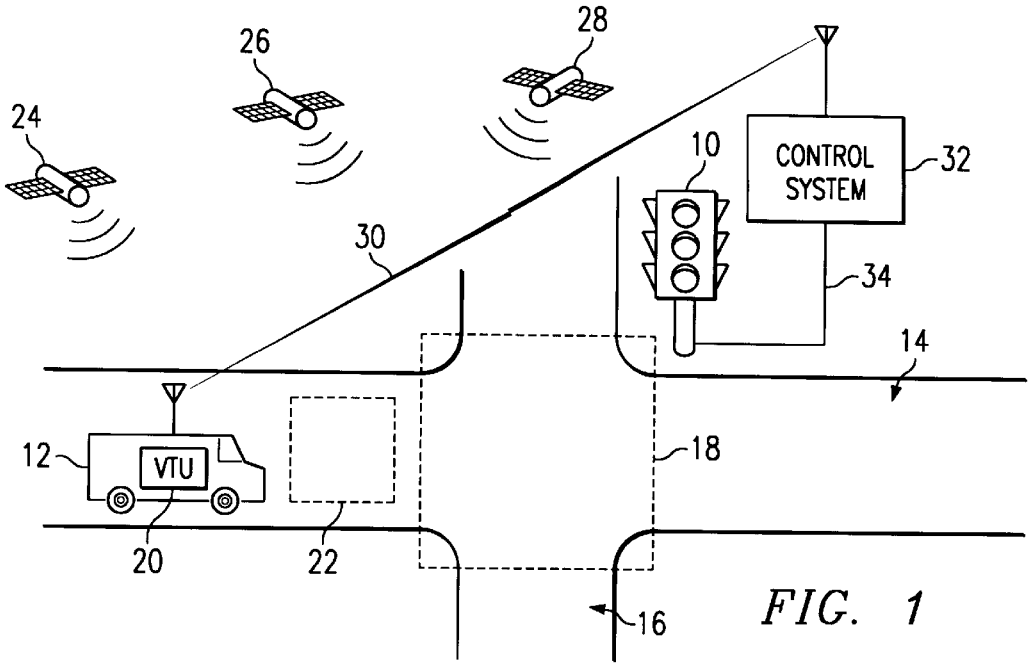
FIG. 1 is a schematic diagram illustrating a system employing a virtual loop detector for regulating switching of a traffic light.
Figure 3:
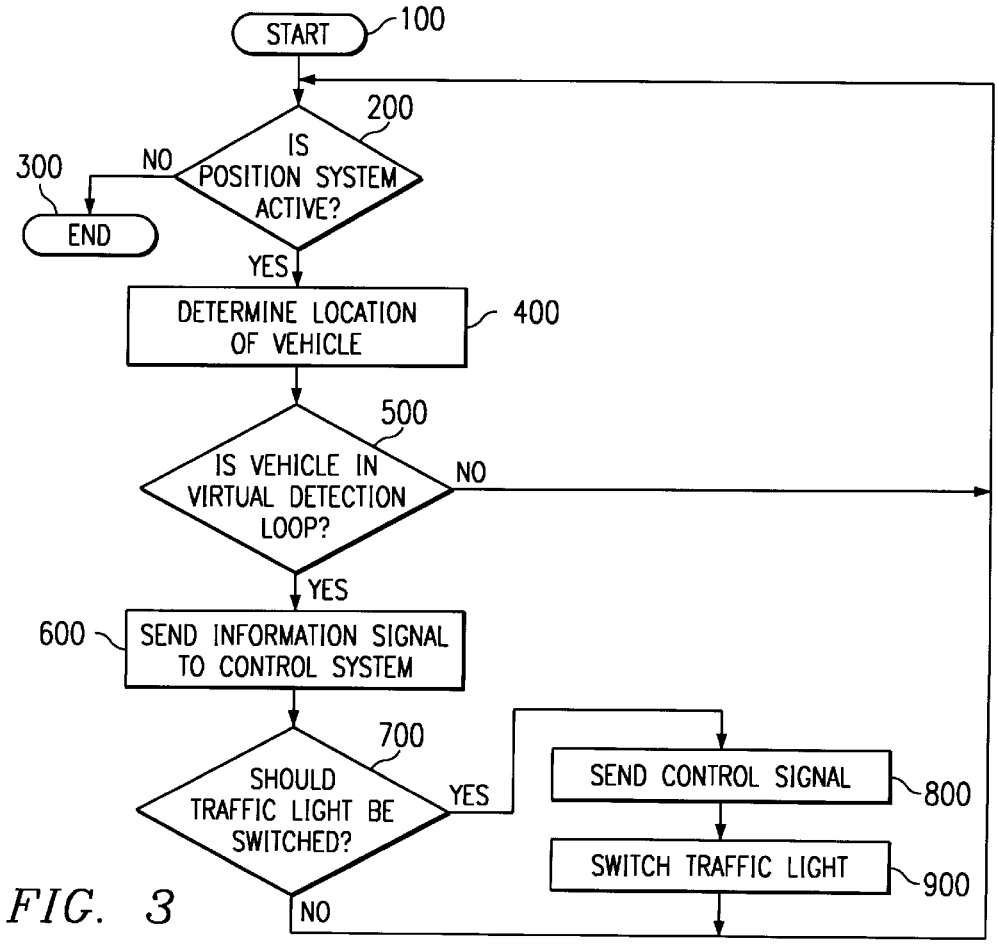
FIG. 3 is a flowchart illustrating a method for regulating the switching of a traffic light.
Figure 2:
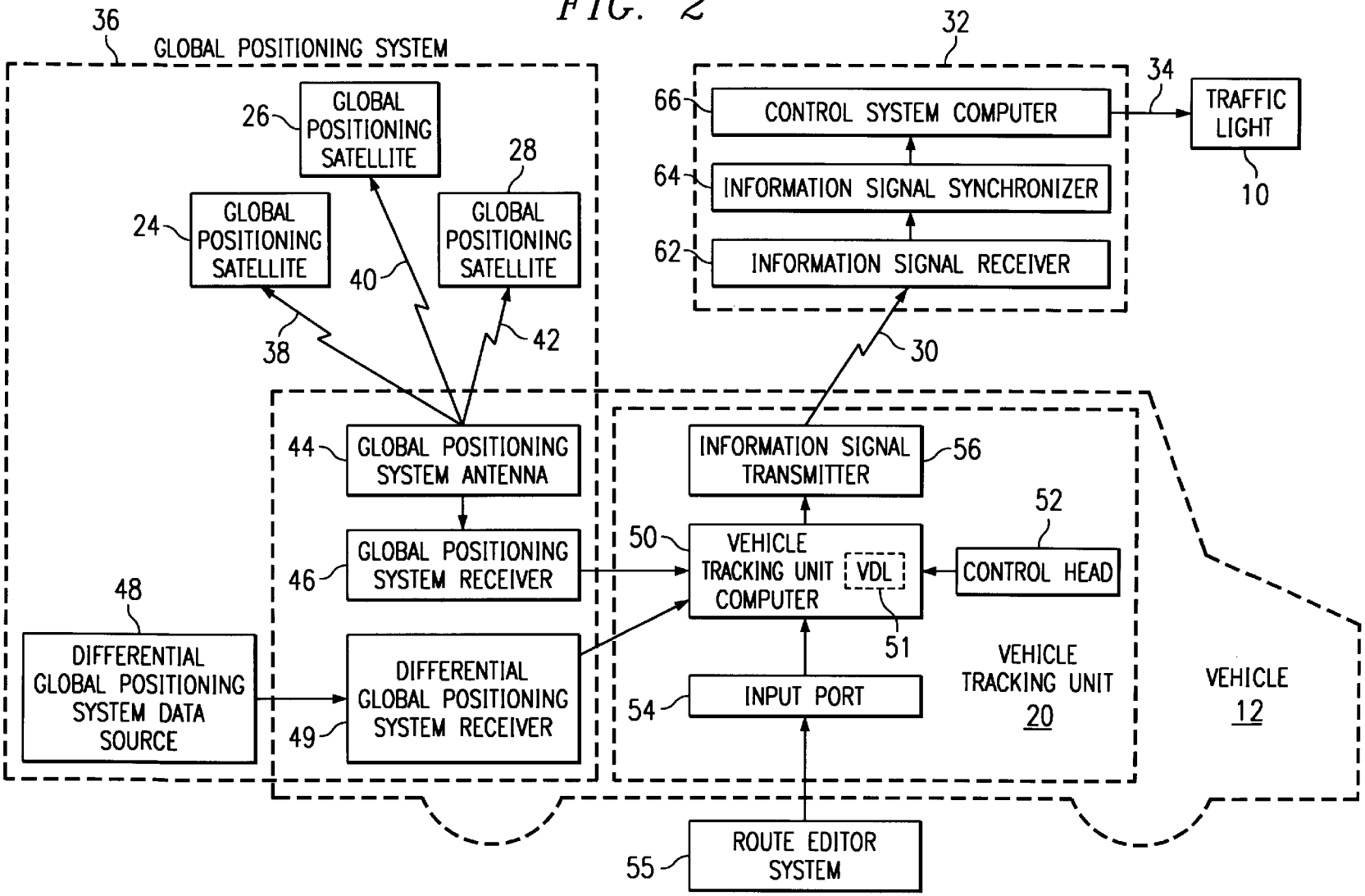
FIG. 2 is a block diagram illustrating the system of FIG. 1 for regulating switching of a traffic light.

The present invention and its advantages are best understood by referring to FIGS. 1 through 3 of the drawings, like numerals being used for like and corresponding parts of the various drawings.

FIG. 1 is a schematic diagram illustrating a traffic signal switching system employing a virtual loop detector for regulating switching of a traffic light 10 as a function of the location of a vehicle 12. This regulation is described in the context of a traffic intersection 18 formed by a road 14 and a road 16, as illustrated in FIG. 1. However, the present invention can operate given any number and configuration of roads that use one or more traffic signals.

A virtual detection loop 22 is established on road 14 proximate to the intersection 18, and the location of the virtual detection loop is stored in a vehicle tracking unit 20, located on a vehicle 12. The virtual detection loop 22 is not a physical component, but rather a set of boundaries defined in a coordinate system. The boundaries of the virtual detection loop 22 are defined in the coordinate system used by the vehicle tracking unit 20, such as latitude and longitude coordinates. The size and position of the virtual detection loop 22 is dependent upon a number of factors including, but not limited to, the accuracy of the vehicle tracking unit 20, the anticipated speed of the vehicle 12, and the unique characteristics of each intersection 18. A vehicle 12 traveling on the road 14 toward the traffic intersection 18 enables the vehicle tracking unit 20 to continuously receive signals from global positioning satellites 24, 26, and 28, and, in response, determines the location of the vehicle 12 on road 14. When the vehicle tracking unit 20 determines that the vehicle 12 has entered the virtual detection loop 22, the vehicle tracking unit ascertains whether control of the traffic light 10 should be preempted. The vehicle tracking unit 20 sends an information signal 30 to a control system 32 if control of the traffic light 10 is to be preempted. The control system 32 determines whether the traffic light 10 should be switched based on the content of the information signal 30 and the current status of the traffic light 10 (e.g., whether or not it is in favor of the vehicle). Switching of the traffic light 10 based on the content of information signal 30 is described in greater detail in conjunction with FIGS. 2 and 3. If the control system 32 determines that the traffic light 10 should be switched, then a control signal 34 is sent from the control system 32 to the traffic light 10 to switch the traffic light 10.

In the manner described above, a system tracks the location of certain types of vehicles, and sends commands to preempt the control of traffic signals that are along the routes of such vehicles. The system operates to determine the type of situations that require the traffic signals to be changed. For example, if the vehicle being tracked is a public transportation vehicle, the system described above can change certain traffic signals in favor of the vehicle if it is behind schedule. In this manner, the operation of the vehicle is enhanced.

FIG. 2 is a block diagram illustrating a traffic light switching system for regulating switching of the traffic light 10. In general, the vehicle tracking unit 20 operates in conjunction with a global positioning system 36 to determine the location of the vehicle 12. The vehicle tracking unit 20 generates the information signal 30 in response to the location of the vehicle 12 in the virtual detection loop 22. The vehicle tracking unit 20 then sends the information signal 30 to the control system 32. The control system 32 determines whether to switch the traffic light 10 in response to the information signal 30. If necessary, the control signal 34 is sent to the traffic light 10 to switch the traffic light 10.

A global positioning system 36 includes a plurality of global positioning satellites. In one embodiment, the global positioning system 36 includes three global positioning satellites, namely global positioning satellites 24, 26, and 28. Although the following details describe a global positioning system 36 with three global positioning satellites, it should be understood that the global positioning system 36 and the vehicle tracking unit 20 operate with at least one global positioning satellite. The global positioning satellites 24, 26, and 28 transmit global positioning system signals 38, 40, and 42, respectively.

The global positioning system 36 also includes a global positioning system antenna 44 located on the vehicle 12. The global positioning system antenna 44 receives global positioning system signals 38, 40, and 42. In addition, the global positioning system 36 further comprises a global positioning satellite receiver 46, a differential global positioning system data source 48, and a differential global positioning system receiver 49. The global positioning satellite receiver 46, located on vehicle 12, receives and processes the global satellite system signals 38, 40, and 42 from the global positioning satellite antenna 44. In one embodiment of the present invention, a Magellan Global Positioning System receiver and a M/A-COM Global Positioning System antenna are used; however, other suitable receivers and antennas are available. The resultant processed information is then sent from the global positioning satellite receiver 46 to the vehicle tracking unit 20. Likewise, the differential global positioning system receiver 49, also located on the vehicle 12, receives and processes information from the differential global positioning system data source 48. In one embodiment of the present invention, a DCI Differential Global Positioning System receiver is used; however, other suitable receivers are available. In addition, Wide Area Augmentation may also be used, which does not utilize a differential receiver but provides the same advantages. The resultant processed information is then sent from the differential global positioning system receiver 49 to the vehicle tracking unit 20. The purpose of using the differential global positioning system receiver 49 is to increase the accuracy of the global positioning system 36.

Also included in the vehicle tracking unit 20 is a vehicle tracking unit computer 50. The vehicle tracking unit computer 50 includes a VDL memory 51 that operates to store the locations of one or more virtual detection loops 22, the location of one or more traffic signals 10, and other information such as route scheduling. This information is downloaded to the vehicle tracking unit computer 50 from a route editor system 55 through an input port 54. The route editor system 55 includes a digitized map of the relevant geographical area. In one embodiment of the present invention, Map Info software provides this map. The user of the route editor system marks the location of the virtual detection loops 22 and the traffic signals 10 on the digitized map. Additional software in the route editor system then converts the chosen locations on the map to latitude and longitude coordinates. It is these coordinates that are downloaded to the vehicle tracking unit computer 50.

The vehicle tracking unit computer 50 receives information on the location of the vehicle 12 from the global positioning system 36 through the global positioning system receiver 46 and the differential global positioning system receiver 49. In one embodiment of the present invention, the vehicle tracking unit computer 50 monitors the location of the vehicle 12 once per second. The vehicle tracking unit 20 also includes a control head 52 coupled to the vehicle tracking unit computer 50 as an input device for an operator of the vehicle 12. In one embodiment of the present invention, the operator of a public transportation vehicle, such as a bus or trolley, uses the control head 52 to enter in route information. In another embodiment the control head 52 is a touch screen liquid crystal display produced by Mentor Engineering.

The vehicle tracking unit computer 50 determines, based on the data received from the global positioning system receiver 46 and the differential global positioning system receiver 49, when the vehicle 12 has entered the virtual detection loop 22. At this point, the vehicle tracking unit 20 functions to determine whether control of the traffic signal 10 needs to be preempted in favor of the vehicle 12. In one embodiment of the present invention, the vehicle tracking unit 20 compares the location of the vehicle 12 with the scheduled location according to a pre-defined schedule. If the vehicle 12 is behind schedule, the vehicle tracking unit 20 determines if control of the traffic signal 10 should be preempted in favor of vehicle 12. In another embodiment, the vehicle tracking unit 20 determines if control of the traffic signal 10 should be preempted when the vehicle 12 is an emergency vehicle, such as an ambulance or a fire truck, en route to or from an emergency situation.

Also included in the vehicle tracking unit 20 is an information signal transmitter 56 coupled to the vehicle tracking unit computer 50. In one embodiment of the present invention, the information signal transmitter 56 is a wireless modem and the associated hardware for transmitting information from the modem, such as an antenna. If the vehicle tracking unit computer 50 determines control of a traffic light 10 should be preempted, it sends information signal 30, via the information signal transmitter 56, to the control system 32. In one embodiment, the information signal 30 also includes data on the location of the virtual loop 22 occupied by a vehicle 12, the intersection number, schedule adherence, route number, vehicle identification number, direction of travel, and time.

Referring to the control system 32, this system includes an information signal receiver 62, information signal synchronizer 64, and control system computer 66. When the control system 32 receives the information signal 30, it analyzes the data and determines whether to switch the traffic light 10. The control system 32 receives the information signal 30 from the vehicle tracking unit 20 through the information signal receiver 62. In one embodiment of the present invention, the information signal receiver 62 is a wireless modem and associated hardware (such as an antenna) for receiving information sent to the modem. The information signal receiver 62 is coupled to and sends the information signal 30 to the information signal synchronizer 64. Coupled to the information signal synchronizer 64 is the control system computer 66. The information synchronizer 64 operates to synchronize any time data received from the vehicle tracking unit computer 50 with an internal clock (not shown) of the control system computer 66. This synchronization is only needed if the control system computer 66 does not use a Global Positioning System time base, the standard used by the global positioning system 36. The information signal synchronizer 64 processes the information signal 30 and sends the resultant processed information to the control system computer 66. The control system computer 66 analyzes the information to determine whether or not to switch the traffic light 10.

The control system computer 66 determines that the traffic light 10 should be switched or not based on numerous types of criteria. For example, if two or more vehicles 12, traveling in different directions, simultaneously transmit signals to the control system 32 to change the same traffic light 10, the control system 32 operates to analyze each information signal 30 and prioritize the signals. For instance, if both an emergency vehicle and a public transportation vehicle simultaneously transmit signals to the control system 30 to change the traffic light 10, the control system may determine that the emergency vehicle has priority and change the light in its favor. Similarly, the control system 32 may determine, as between two transportation vehicles, which vehicle is further behind its schedule and switches the light accordingly. If control the system computer 66 determines that the traffic light 10 should be changed, it sends the control signal 34 to the traffic light to be switched.

Referring to FIG. 3, there is illustrated a flowchart for regulating the switching of the traffic light 10. The process starts at a step 100 and advances to step 200. At step 200, the status of the vehicle tracking unit 20 is determined. If the vehicle tracking unit 20 is not active, then the process ends at a step 300. If the vehicle tracking unit 20 is active, then the vehicle tracking unit 20 will determine the location of vehicle 12 at a step 400 based on data from global positioning system 36. At a step 500, the process determines if the vehicle 12 is in a location corresponding to the location of the virtual detection loop 22. If the step 500 results in a negative response, then the process returns to step 200 to determine if the vehicle tracking unit 20 is active. At a step 500, the process determines if the vehicle 12 is in a location corresponding to the virtual detection loop 22. A positive response advance the sequence to step 600 to send an information signal 30 to the control system 32. At a step 700, the control system 32 determines if the traffic light 10 should be switched based on the information signal 30. If the control system 32 determines that the traffic light 10 should not be switched, then the process returns to step 200 to determine if the vehicle tracking unit 20 is active, at step 200. If the control system 32 determines that the traffic light 10 should be switched, then the control system 32 sends the control signal 34 to the traffic light 10, at step 800. At step 900, the traffic light 10 receives the control signal 34 and is switched. The process then returns to determining if the vehicle tracking unit 20 is active, at step 200, whereby the method is repeated.

Although the present invention has been described with a preferred embodiment, variations and modifications may be suggested to one skilled in the art, therefore, it is intended that the present invention encompass such variations and modifications as fall within the spirit and scope of the appended claims.

What is claimed is:

1. A method of regulating traffic controllers, comprising:

storing in a vehicle tracking unit one or more virtual detection loops;

storing in the vehicle tracking unit one or more traffic controller locations;

determining the location of a vehicle;

determining from the location of the vehicle entry of the vehicle into one of the stored virtual detection loops;

determining when one of the traffic controllers requires preemption in favor of a vehicle that has entered one of the stored virtual detection loops;

transmitting in response to a determination that a vehicle has entered one of the stored virtual detection loops and a traffic controller requires preemption, an information signal to a control system, the information signal including the location of the vehicle; and analyzing the information signal to preempt the traffic controller in favor of the vehicle that has entered one of the stored virtual detection loops.

2. A method of regulating traffic controllers as set forth in claim 1, further comprising:

defining each of the one or more stored virtual detection loops by latitude and longitude coordinates.

3. A method of regulating traffic controllers as set forth in claim 1 wherein analyzing the information signal comprises:

prioritizing information signals received from a plurality of vehicles.

4. A method of regulating traffic controllers as set forth in claim 1, wherein transmitting the information signal comprises transmitting information including an identity of the vehicle, location of the vehicle, direction of travel of the vehicle, speed of vehicle, and time of transmission of the information signal.

5. A vehicle traffic control system for preempting a traffic controller in favor of an identified vehicle, comprising:

a vehicle position detector mounted in a vehicle, said vehicle position detector responsive to location signals for generating a vehicle position signal;

a vehicle tracking unit mounted in the vehicle, said vehicle tracking unit storing one or more virtual detection loops defined by latitude and longitude coordinates, said vehicle tracking unit further storing one or more traffic controller locations;

said vehicle tracking unit comparing the vehicle position signal with one or more of the virtual detection loops to determine when the vehicle has entered one of the stored virtual detection loops and further determining when one of the traffic controllers requires preemption in favor of a vehicle that has entered one of the stored virtual detection loops;

a control system for analyzing one or more information signals to determine whether to preempt a traffic controller in favor of a vehicle that has entered one of the stored virtual detection loops; and an information signal transmitter mounted in the vehicle, said information signal transmitter responsive to a determination that a vehicle has entered one of the stored virtual detection loops and a traffic controller should be preempted to transmit an information signal to the control system, the information signal including the location of the vehicle.

6. A vehicle traffic control system as set forth in claim 5 further comprising:

a route editor for inputting to the vehicle tracking unit latitude and longitude coordinates of the one or more stored virtual detection loops.

7. A vehicle traffic control system as set forth in claim 6 further comprising:

a control head for user input of information to the vehicle tracking unit.

8. A vehicle traffic control system as set forth in claim 5 wherein the control system further comprises:

a control system computer for prioritizing information signals received from a plurality of vehicles.

9. A vehicle traffic control system as set forth in claim 5 wherein the control system further comprises:

an information signal synchronizer for synchronizing information signals for analysis to determine whether to preempt a traffic controller.

* * * * *